United States Patent [19]

Right

[11] Patent Number: 4,956,634

[45] Date of Patent: Sep. 11, 1990

[54] CITY TIE LINE CONNECTION FOR FIRE ALARM SYSTEM

[75] Inventor: Robert W. Right, Huntington, Conn.

[73] Assignee: General Signal Corporation, Stamford, Conn.

[21] Appl. No.: 345,598

[22] Filed: May 1, 1989

[51] Int. Cl.[5] ..... G08B 19/00

[52] U.S. Cl. ..... 340/521; 340/521; 340/825.55

[58] Field of Search ..... 340/531, 532, 521, 505, 340/511, 518, 517, 524, 525, 660, 661, 825.06, 825.07, 825.08, 825.09, 825.1, 825.11, 825.12, 825.13, 825.54, 825.55

[56] References Cited

U.S. PATENT DOCUMENTS 4,103,337 7/1978 Whiteside .
4,225,819 2/1988 Sasaki et al. .
4,489,312 12/1984 Yoshizaki .
4,506,255 3/1985 Sazaki .
4,518,952 5/1985 Tanaka et al. .
4,525,700 6/1985 Kimura et al. .
4,550,306 10/1985 Kimura .
4,581,604 4/1986 Kimura et al. .
4,623,920 6/1987 Ferguson et al. ..... 340/531
4,636,649 1/1987 Kimura et al. .
4,658,243 4/1987 Kimura et al. .
4,668,939 5/1987 Kimura et al. .
4,701,625 10/1987 Kimura .
4,725,821 2/1988 Kimura et al. .
4,733,224 3/1988 Kimura .

*Primary Examiner*—Joseph A. Orsino
*Assistant Examiner*—Frank M. Scutch, III
*Attorney, Agent, or Firm*—Robert R. Hubbard; John F. Ohlandt

[57] ABSTRACT

Improvement to a fire alarm system that enables a city tie line connection to be made selectively. Terminal units at a variety of locations are coupled or connected in separate, independent loops within the system such that serial synchronous power transmission and data communication is effectuated over the individual loops. A master controller at a central location is programmed to recognize that certain terminal units connected in particular loops of the system are in alarm states and to cause a city tie line connection to be made, selectively, whereby a municipal fire department or the like is informed of the particularly critical alarms emanating from those terminal units.

4 Claims, 2 Drawing Sheets

CITY TIE LINE CONNECTION FOR FIRE ALARM SYSTEM

BACKGROUND OF THE INVENTION

This invention relates to a fire alarm or similar system, and more particularly to a microprocessor-based system in which serial synchronous power transmission and data communication are provided between a central station or panel and groups of terminal units; such system functioning, by means of independently operable loop controllers, to signal or indicate alarm conditions and the like so that supervisory personnel can be adequately informed of hazardous conditions.

In a fire alarm system of the type just described, groups of terminal units are addressed by a so-called polling routine so that a microprocessor in the respective independent loop controller can determine the alarm states, if any, of its terminal units on a continuous basis. Thus, each of the terminal units, for example, 126 units on each of seven loops or lines, can be addressed cyclically, e.g., once every several seconds or so by its respective loop controller. If a given unit, during any cycle, is determined to be in the alarm state, then that information is communicated to the respective loop controller, and therefrom to a master controller so that a warning to supervisory personnel can be given.

When one or more units are found to be in alarm, the information is displayed on the central control panel. Such information is also printed out by a printing device. Meanwhile, information is obtained by the loop controller, for example, as to the type of terminal unit that is in the alarm state, and its location. Moreover, the loop controller upon receiving notification of an alarm status, sends a command to the particular terminal unit in alarm to illuminate its light emitting device so that personnel stationed nearby may precisely locate the outbreak of fire.

A fuller understanding of the operation of such a fire alarm system will be gained as a description of a detailed embodiment of the present invention proceeds. At that time, reference will be made to FIG. 1, in which the context of the invention is depicted, such context being a known fire alarm system of the type just described.

Accordingly, it is a fundamental object of the present invention to provide a city tie line arrangement whereby municipal fire authorities may be notified on a selective basis as to particular conditions that exist calling for the services of such authorities.

Another object is to make the connection of the city tie line completely programmable by the user such that he may determine by use of an interface which conditions or situations should call for notification of municipal fire authorities.

SUMMARY OF THE INVENTION

The above and other objects are fulfilled by a primary feature of the present invention by which selectivity is enabled in the connection of a city tie line to the system so that responses from predetermined sources can cause notification of the municipal fire authority. This is accomplished specifically by programming the master controller so that it exercIses control over an auxiliary relay. Upon finding that a particular source or unit matches a source or unit recorded in a correlation table within the master controller, that relay is actuated to cause the aforesaid connection of the city tie line.

More specifically, the present invention enables the selectivity, already described, by means of an interface oPerated by the user according to which he can list a particular source or unit in the master controller's correlation table and hence effectively program the connection of the city tie line in response to a particular source or unit being in alarm or the like.

Accordingly, a primary feature of the invention may be defined as apparatus for selectively connecting a city tie line to the fire alarm system; a plurality of transmission loops; a plurality of terminal units connected to each of said transmission loops; each of said terminal units having comparison means for determining whether a received address signal coincides with an identification address stored in the terminal unit, said comparison means producing an output signal responsive to coincidence; loop controllers connected to the respective transmission loops; a master controller for receiving data from said loop controllers as to the alarm status of said terminal units; a city tie line adapted to be connected to municipal fire authorities; means forming part of said master controller for selectively connecting said city tie line to provide a warning to municipal fire authorities.

Other and further objects, advantages and features of the present invention will be understood by reference to the following specification in conjunction with the annexed drawing, wherein like parts have been given like numbers.

DESCRIPTION OF PREFERRED EMBODIMENT

Figure 1:
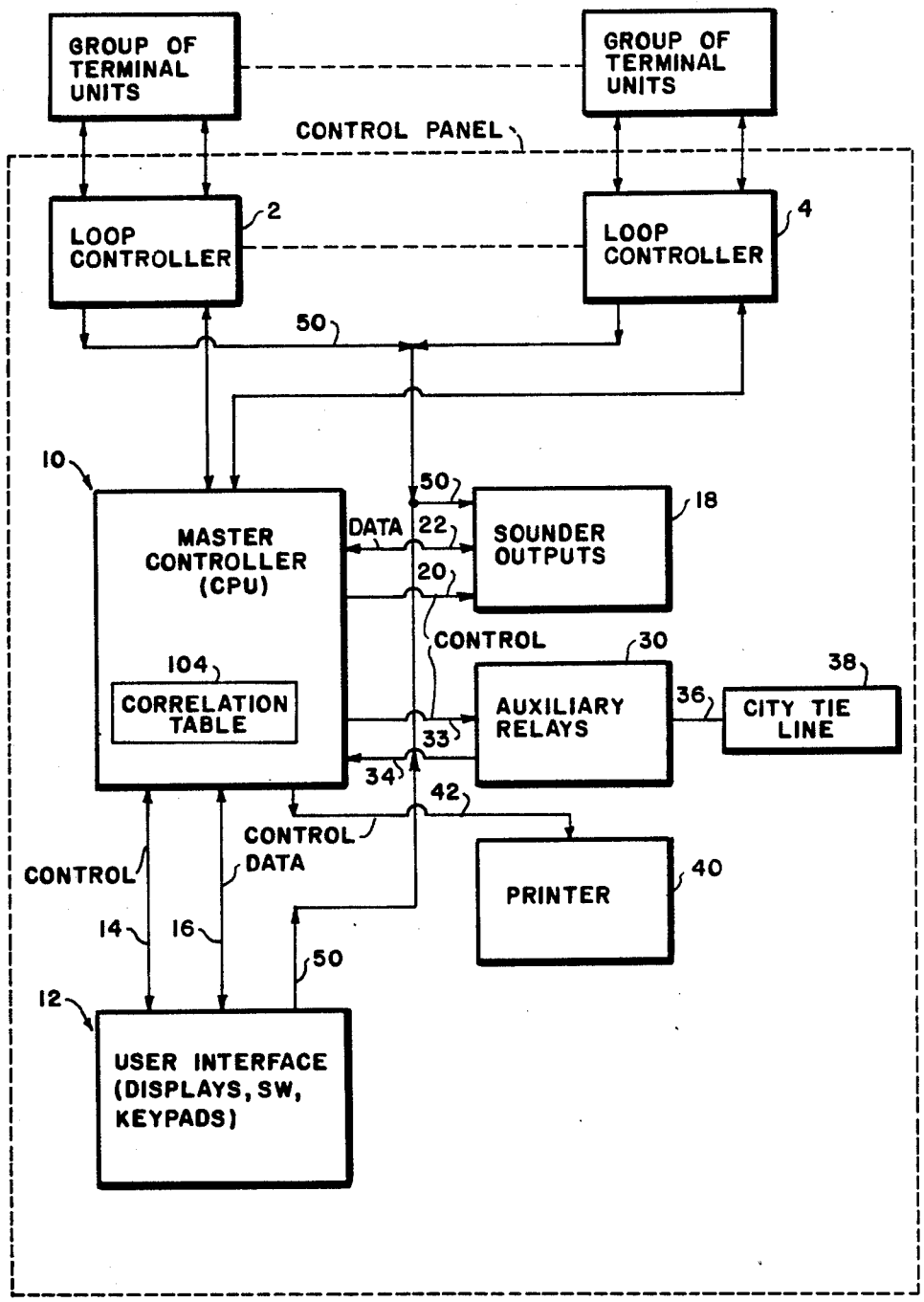
FIG. 1 is a block diagram of the fire alarm system forming the context in which the present invention is incorporated.

Referring now to the figures of the drawing and, in particular, first to FIG. 1, there will be seen a functional block diagram of the entire system for detectIng the outbreak of fire or other hazardous conditions. For the sake of simplicity, certain equiPment such as batteries, power mains, chargers and the like normally used for supplying power to the system have not been shown in FIG. 1. Another related invention operative in the FIG. 1 context is described in patent application ED-244.

It will be understood that a control panel is provided and that the overall system depicted in FIG. 1 forms a context in which the related invention, application ED-245, may be incorporated. That related invention is adaPted to operate as part of the loop controllers, such as loop controllers 2 and 4 seen in FIG. 1.

In connection with the invention of the present controller 10 is at the center of the system, such master controller including a conventional CPU. Also, the particular master controller seen includes a correlation table for purposes which will be explained.

The controller 100 is responsible for the "high level" functions involved in the system and thus the master controller issues commands and instructions to individual loop controllers, and receives responses from these loop controllers. Moreover, the master controller 10 communicates with the user interface 12 to permit the user to enter a variety of user instructions to the system. Accordingly, the user interface 12 includes a variety of display means, switches, keypads, and so forth, such user interface being generallY well known to those skilled in the art.

For purposes of the present invention, the user interface functions to enable the entry in a correlation table of certain critical terminal units of all those notifying the master controller when they are in alarm. All the addresses of terminal units in alarm are entered in suitable storage means in the master controller, and- are then compared with the entries of critical units in the correlation table. If a match is obtained, action is taken to alert the municipal fire authorities that conditions are such that immediate attention by such authorities is necessary. This feature will be explained in further detail as the description proceeds.

For providing a variety of audible signals in order that supervisory personnel may be properly alerted to alarm and trouble conditions, a group of sounder outputs 18 is provided (to the right of the master controller 10). The sounder outputs are interconnected with the master controller by control line 20 and data line or bus 22. A set of auxiliary relays designated 30 is likewise connected to the master controller 10; again, by means of similar control and data lines, in this case by control line 32 and data line or bus 34.

One of the auxiliary relays of the set 30 is selected to provide the connection by means of connection 36 to a city tie line 38, whereby a municipal fire department or the like can be suitably notified. This constitutes a specific feature of the present invention.

It will also be noted that a printer for printing out significant information, thereby making a permanent record of reported conditions and the like, is designated 40 and is connected by control line 42 to the master controller 10.

In order to provide an evacuate override signal as an indicator for disastrous conditions (fail-safe), a line 50 is extended between the user face 12 and the sounder outputs 18; such line also extending to the loop controllers 2 and 4.

As has been previously mentioned, seven loops are normally involved in the system of the type described; thus, the dotted line between the loop controllers 2 and 4 and between the groups of terminal units represent five other loop controllers and their loops. Also, it will be appreciated that the seven loops function independently of each other and communicate with the master controller only when called by the master controller; or in the event of an emergency condition, for example, if terminal units go into alarm.

Because of the provision of the line 50 being extended as described, then if anything of disastrous consequence goes wrong with any of the loop controllers or the user interface, signals are fed into the sounder outputs 18 to provide an indication of such disastrous conditions.

Figure 2:
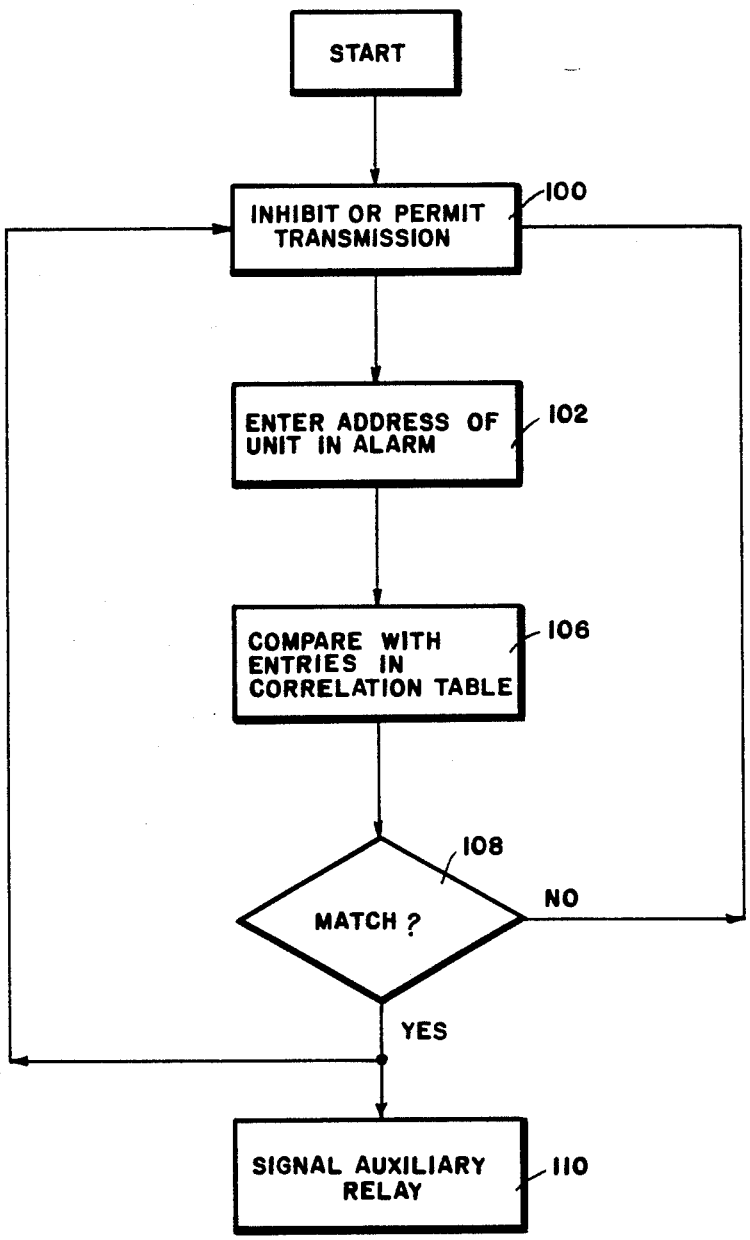
FIG. 2 is a flow chart depicting the operation involved in selectively making the connection of the master controller to the city tie line so that appropriate warning may be given to municipal fire authorities.

Referring now to FIG. 2, a flow chart is depicted for the operations involved with the primary feature of the present invention, that is, the arrangement whereby the city tie line 38 is enabled or activated such that the municipal fir authorities can be warned of especially dangerous conditions. The operations involved include the step 100, performed by suitable means in the master controller, of normally permitting addresses of terminal units in alarm to be entered in a suitable register or like means in the master controller.

The next operational step is 102, that is, the operation of entering the address of a particular unit in, for example, a shift register or similar means in the master controller.

Then, the entered address value is compared with the entries in the correlation table 104 within the master controller 10, the operation seen as 106 in FIG. 2.

Thereafter, if there is a match in accordance with operation 108, an operation 110 is performed whereby a signal is sent over control line 32 to control the auxiliary relay 30, that is, to put it in such a state that a tie line connection is made or activated.

Also, in the event that a match has been obtained, the inhibit transmission 100 is effectuated, inasmuch as it is no longer necessarY, should another transmission unit be in alarm, to do anything since the city tie line has already been connected.

However, in the event that there is no match, at operation 108, the "no" response causes a permitting of transmission which, of course, simply means that normal transmission of the next address of a unit in alarm takes place.

While there has been shown and described what is considered at present to be the preferred embodiment of the present invention, it will be appreciated by those skilled in the art that modifications of such embodiment may he made. It is therefore desired that the invention not be limited to this embodiment, and it is intended to cover in the appended claims all such modifications as fall within the true spirit and scope of the invention.

I claim:

1. Apparatus for selectively connecting a city tie line to the fire alarm system;

a plurality of transmission loops;

a plurality of terminal units connected to each of said transmission loops;

each of said terminal units having comparison means for determining whether a received address signal coincides with an identification address stored in the terminal unit, said comparison means producing an output signal responsive to coincidence;

loop controllers connected to the respective transmission loops for transmitting address signals thereon;

a master controller for receiving data from said loop controllers as to the alarm status of said terminal units;

a city tie line for connecting to municipal fire authorities;

means forming part of said master controller, including a correlation table, for selectively connecting, in response to particular terminal units being in alarm, said city tie line to provide a warning to the municipal fire authorities concerning those terminal units;

an auxiliary relay for enabling the selective connection of said city tie line.

2. Apparatus as defined in claim 1, further including a user interface for selectively changing the terminal units to which said city tie line will respond so as to be connected to, and thereby notify, said municipal fire authorities.

3. Apparatus as defined in claim 2, further comprising a group or set of auxiliary relays connected to said master controller, said city tie line being adapted to be connected to one of said auxiliary relays.

4. Apparatus as defined in claim 3, further including devices for producing sounder outputs, and further including a printer, said sounder outputs and printer being connected to said master controller.

* * * * *